United States Patent [19]

Alimbau Marques

[11] Patent Number: 4,457,391

[45] Date of Patent: Jul. 3, 1984

[54] FOLD-UP LADDER

[75] Inventor: D. Salvador Alimbau Marques, Barcelona, Spain

[73] Assignee: Andral Corporation, Williamsville, N.Y.

[21] Appl. No.: 341,830

[22] Filed: Jan. 21, 1982

[30] Foreign Application Priority Data

Jan. 28, 1981 [ES] Spain ..... 256.261[U]
Apr. 15, 1981 [ES] Spain ..... 288.208[U]

[51] Int. Cl.[3] ..... E06C 1/383

[52] U.S. Cl. ..... 182/164; 182/211; 182/196

[58] Field of Search ..... 182/164, 163, 24, 211, 182/196–198

[56] References Cited

U.S. PATENT DOCUMENTS

| | | | |
|---|---|---|---|
| 303,884 | 8/1884 | Reisener | 182/164 |
| 308,179 | 11/1884 | Linnenbrink | 182/164 |
| 311,661 | 2/1885 | Joyut | 182/164 |
| 1,228,248 | 5/1917 | Rudd | 182/24 |
| 1,644,739 | 10/1927 | McCracken | 182/164 |
| 1,722,844 | 7/1929 | Faulkenberry | 182/163 |
| 2,529,112 | 11/1950 | Steele | 182/164 |
| 3,216,526 | 11/1965 | Cole | 182/163 |
| 3,554,318 | 1/1971 | Knight | 182/163 |
| 3,655,012 | 4/1972 | Hoffmann | 182/163 |
| 3,730,295 | 5/1973 | Deese | 182/163 |
| 3,811,151 | 5/1974 | Kuemmerlin | 182/163 |

FOREIGN PATENT DOCUMENTS

| | | | |
|---|---|---|---|
| 433724 | 8/1935 | United Kingdom | 182/164 |

*Primary Examiner*—R. P. Machado
*Attorney, Agent, or Firm*—James J. Ralabate

[57] ABSTRACT

A portable folding ladder comprising a plurality of U-shaped modules having a rung and two vertical portions, the modules movable connected to each other, and when opened becoming progressible narrower as they approach the top of the ladder, when folded the narrower modules fitting inside of the next wider modules and locking means to lock the modules in a rigid manner when the ladder is extended and open.

15 Claims, 4 Drawing Figures

FOLD-UP LADDER

BACKGROUND OF THE INVENTION

It is known to use various forms of collapsable and fold up ladders for both domestic and commercial use. A number of these prior art embodiments are very bulky when folded and are extremely difficult to carry. In addition several of these ladders require time consuming and difficult processes for dis-engaging the ladder after use. Correspondingly, most of these known ladders are troublesome to set up for use after storage.

Typical fold up ladders are disclosed in U.S. Pat. Nos. 3,216,526; 3,554,318; 3,655,012; 3,730,295; and 3,811,151.

At present, the fold up ladders known on the market consist of sections of several treads which are almost of the same length as that of the main strut of the portable ladder itself, to which it backs. These additional sections are linked by clamps to the couple of main struts between which the treads are placed.

These clamps secure the struts of the main and secondary sections allowing the longitudinal extension of this secondary section along the main one in the length it allows and its securing required by means of anchorage of one section in relation to the other. Another design consist in linking both sections, main and secondary on their ends by a hinged joint.

Nevertheless, this other solution is less reliable for the use of the ladder, as the securing lugged nut has to exert a great pressure in the aligned position in order to avoid the collapsing of the end of the ladder once it has been subject to the load of the person stepping on the additional top section, the effect of which load is still aggravated by the increase originated by the lever arm of the lengthening section itself. Therefore, this model is still less safer than the first. Nevertheless, both show the drawback of the difficulty of handling of collapsible ladders, as well as that of their weightiness and of that of requiring too much space when not in use, specially if they have to be carried from one working site to another, as they usually do not fit into small cars.

As noted above, the presently available ladders have serious drawbacks when assembling for use, or disengaging for storage. In addition they are relatively expensive to manufacture and not always structurally reliable when in use.

SUMMARY OF THE INVENTION

It is therefore an object of this invention to provide a fold-up portable ladder devoid of the above noted disadvantages.

Another object of this invention is to provide a fold-up and portable ladder that is comparatively easy and relatively inexpensive to manufacture.

Another further object of this invention is to provide a ladder that is structurally sound, and reliable for both domestic and commercial use.

A still further object of this invention is to provide a fold-up ladder that is relatively compact when folded, is easily stored or carried, and simple to fold down when not in use.

Another further object of this invention is to provide a light-weight ladder that can be easily converted into step ladders of various lengths and designs, even step ladders where the A-frames are of different lengths.

The foregoing objects and others are accomplished in accordance with this invention by providing a novel foldup portable ladder which comprises a plurality of "U"-shaped sections, that form both the rungs and side rails of a ladder when assembled, each section attached and hinged at its lower portion to the next adjacent section, positioned below each of said hinges are latches adapted to fit into and mate with an aperture located in the vertical wall of the said next adjacent section, the lowest of said U-shaped sections being the widest and the top uppermost of said U-shaped sections being the narrowest and each of said sections in between being progressively narrower as they approach the top section. The latches are spring loaded so that when aligned with and mated into said aperture they will remain in place and securely hold each rung in position. To disengage each latch, there is positioned in each horizontal rung portion a spring and an external latch or spring release. When the pair of latch or spring releases are pinched together, the latch is forced away from said apertures and releases each U-shaped section from the next adjacent section. The vertical arms of each U-shaped section thus are connected to and aligned with the next section by the use of latches located in the horizontal base of each U-shaped section. The latches in the horizontal base fit into the orifice or aperture in each vertical section adjacent to it. Each aperture has tapered groves or slide portions that allow the latches to slip into the aperture easily when setting the ladder up for use. Also, the tips of each latch portion is tapered to conform to the configuration of each orifice or aperture slide portion that facilitates the movement of the latch into the aperture. The spring releases need not be manipulated when setting up the ladder, only when the ladder is to be folded up after use.

Any suitable material may be used in the construction of the ladder, typical materials are steel, aluminum, other metals, plastics such as polycarbonates, polyurethanes, polyesters, polyvinyl materials, or other polymers. Also wood fiber glass, or other synthetic materials may be used. To avoid this drawback, the subject of the present Model of Utility has been designed, thanks to which the ladder consists of as many different sections as treads compose it, being hinged one to that immediately following it, upwards in dimension, all of them being inscribed in the lowermost tread or section of dimensions greater than all the remaining components of the ladder. In this manner, when the ladder has been folded down, the same consists of a multiplicity of tread-sections inscribed ones inside the others, the whole constituting an assembly easy to taking with shouldered and passing the arm through the central orifice in the same manner as a roll of rope is born.

On the other hand, this design also allows it to place the folded-down ladder inside the luggage compartment of passenger cars.

To its correct understanding, a case of practical realization is described beneath, as an example only, with no limitative character, of the new fold-up ladder, enclosing one sheet of drawings on which:

BRIEF DESCRIPTION OF DRAWINGS AND DESCRIPTION OF THE PREFERRED EMBODIMENTS

The preferred embodiment of this invention is illustrated in the accompanying drawing and description.

Figure 3:
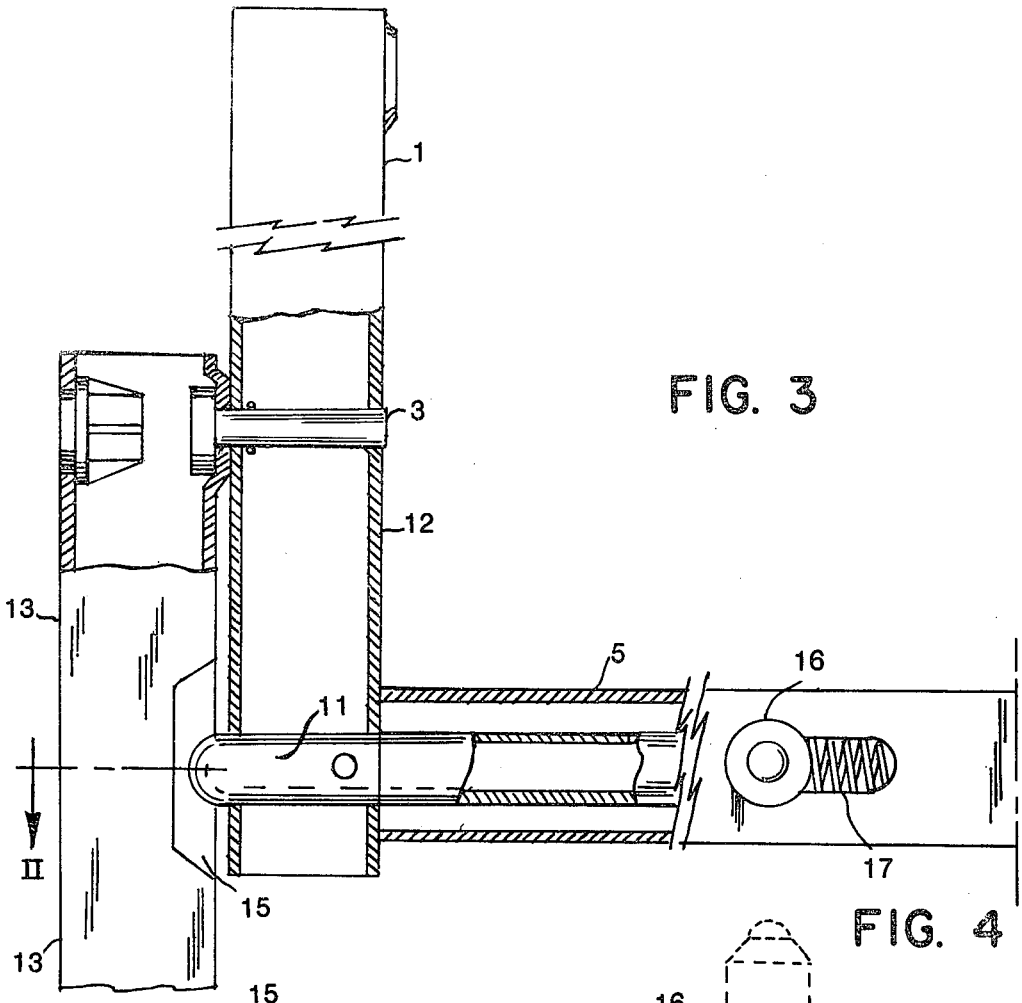
FIG. 3 is a partial side view of the locking mechanism of this invention, illustrating the complete module locking means, consisting of the latch and latch release means and aperture mating section.
Figure 4:
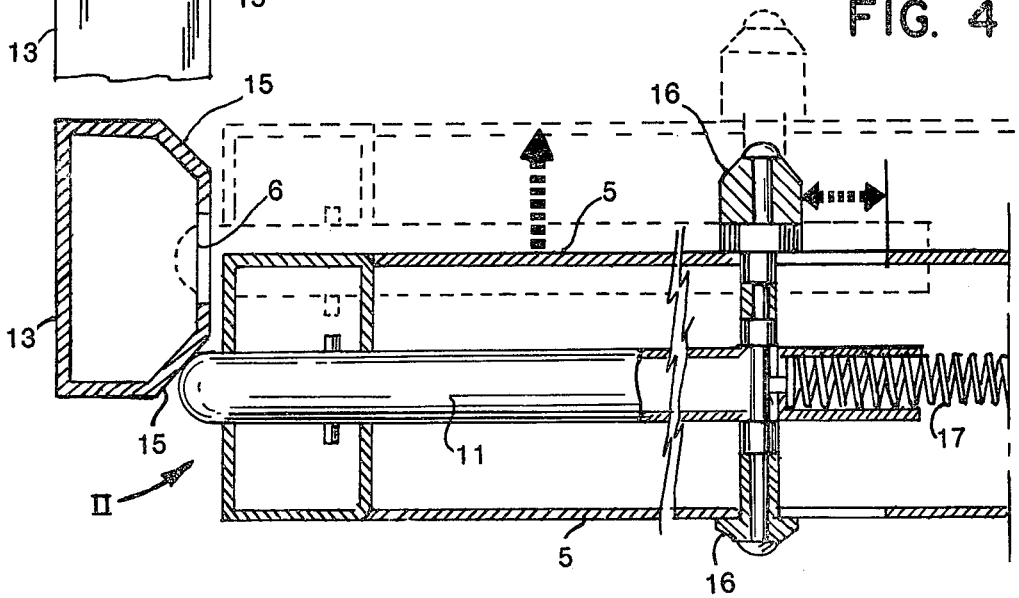
FIG. 4 is a partial top view of this same locking mechanism.

The invention consists in the ladder being made up of a multiplicity of "U:-shaped modules or sections, showing the shape of a rectangular frame lacking of one of the smaller laterals (2), each of which frames has its two arms hinged (3) to the two arms of the following smaller module, for which reason, in the folded position, every module (1) of the ladder is inscribed inside the frame of the foregoing one, except the largest (1A) corresponding to one end of the ladder and by swinging them, the modules (1) become alternatively placed in such a position ones to the others, that the ends of the arms of one group of modules faces the ends of the arms of the other group of modules, all them becoming placed in the same plane, out of which they are taken at the users will by pulling the last smallest module (1B) upwards, so that the assembly of modules (1) advances up to a certain limit, after which every module (1) is swung around itself for 180 with reference to the formers, so that all the modules (1) become aligned to each other, by keying elements (4) arranged on each module so that in the aligned position of the greater lateral struts, the keying elements of one of the individual frames introduce in the orifices arranged in the lateral struts of the aligned opposite module, the treads of the ladder therefore forming the own bases (5) of every "U"-shaped module. While in FIGS. 1 & 2 keying elements or latches (4) extend beyond the plane of arms (1), in FIGS. 3 & 4 they do not. Latch (11) in FIGS. 3 & 4 are locked internally.

DESCRIPTION OF DRAWINGS AND PREFERRED EMBODIMENTS

The invention consists as earlier noted in that the foldable portable ladders of the type made up by a multiplicity of "U"-shaped sections (1) duly linked one to the other by hinged means (3), inscribed in the external one, which is the largest of said sections and the following of smaller size in what concerns the foregoing section and with rectractable means of fastening the frames in their extended position, characterized by the fact that the latch (11) securing one section (12) with reference to its immediately following section (13) is arranged in the tread-base (5) of the "U"-of every section, the head of rung (5) which is shaped ogivally with its peak blunted or shaped in any other form that eases the sliding of the latch (11) that emerges out of every arm or rung (5) of the "U" in its linking point to the base and neaar to the end of the mentioned tubular arm of rectangular section, a chamber (15) being shaped in every one of the vertical edges of the inside face of every arm (15) and at the same height to each other. At the centre of said internal face and between two chambers, the opening or orifice (6) of the location for the head of the latch (11) has been envisaged, which chambers (15) on being one section swung with reference to the immediate other section, the head of the latch (11) emerging from the base (5) of the "U" of a section (12) encounters the corrresponding chamber (15) of the adjacent section (13), which, in view of the inexistence of the chamber, this acts as a ramp on which the head of the latch (11) is forced back, and which on becoming one section (12) aligned with another (13) penetrates into the central locating orifice (6). Latch (11) in FIGS. 3 & 4 only extend into orifice (6) and does not pertrude through arm section 13 or section 1 of FIGS. 1 & 2. In FIG. 4 the solid line drawing show rung (5) in released position and dotted line in locked position. FIG. 4 shows by doted line adjacent release (16) the direction release (16) will go when pinched together for release. Spring (17) facilitates both holding and releasing latch (11) from orifice (6). Dotted line adjacent (5) shows (5) in locked position.

Latch release (16) when pinched together will release latch (11) and withdraw it from orifice (6) permiting the ladder to be folded as hinges (3) hold to sections together for folding.

At present in prior art ladders there exists the drawback that if one section swings around its pivot to fold and becomes applied to the following section, in the moment in which the section of longitudinal beam that constitutes the folding or unfolding section comes to a position in which it grates the longitudinal beam of the immediate following section, the latch that always aims to emerge totally has to be pulled back by hand, as it is expelled by virtue of the antagonist action of the incorporated elastic means, and which, in the aligned position of the sections arranged perpendicularly or juxtaposed will make up every strut of the unfolded ladder or the inscription of one section inside the other when the ladder has been folded down.

To avoid this drawback of having to actuate by hand every one of the latches of every section of the right strut as well as that of the left one of the ladder, the present Model of Utility has been applied for, as it allows that this retention and re-emergency of the latch be carried out automatically without the intervention of the hands of the user of the ladder, merely by the friction of the matching surfaces of the latch and of the strut's edges.

Figure 1:
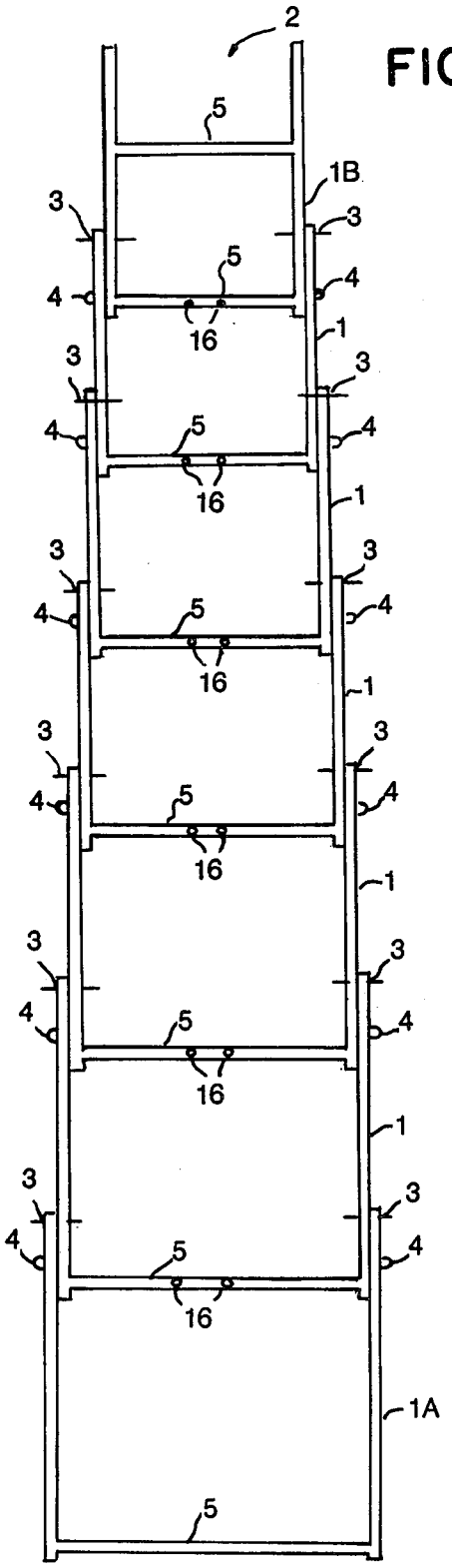
FIG. 1 shows diagramatically a ladder built in accordance with the invention, unfolded so that every section is aligned with respect to the foregoing one, being fixed through the corresponding rectractable securing fasteners, whilst
Figure 2:
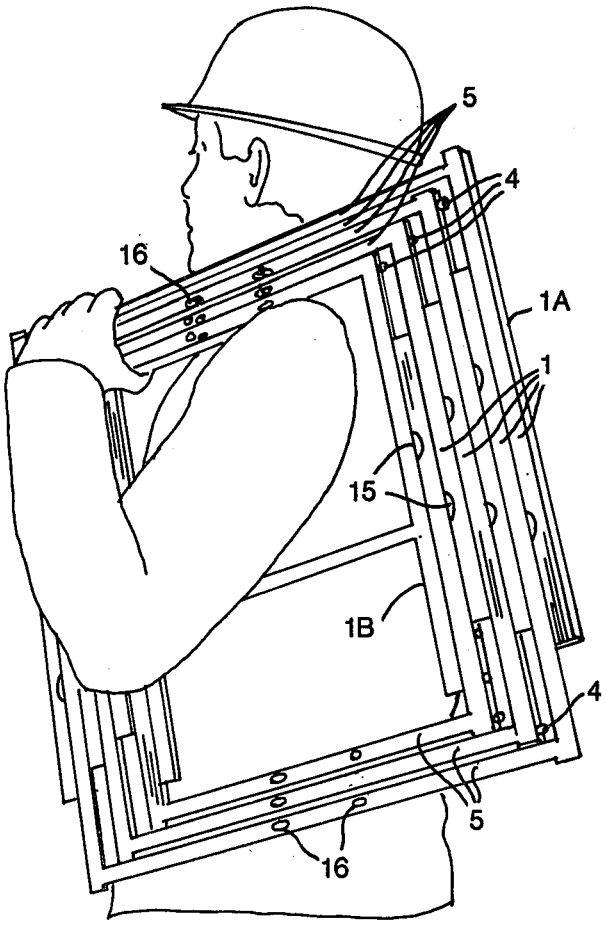
FIG. 2 shows the same ladder, after having capsized its sections and folded them down completely being carried by the user on his shoulder.

FIGS. 1 and 2 illustrate an embodiment of this invention where latch or keying element (4) extendsthrough the vertical arms 1,1A, or 1B and can be seen external of the ladder. A second embodiment is shown in FIGS. 3 and 4 where latch (11) does not extend through the arm (13) but merely penetrates into orifice 6 in section (15) of arm (13), and cannot be seen beyond the outer edge of arm (13), or vertical arms 1,1A, or 1B of FIGS. 1 & 2. FIG. 2 clearly shows the tapered grooves or chambers (15) that facilitate the entrance of latch (11) into orifice (6) of FIGS. 3 & 4.

What is claimed is:

1. A portable folding lean to ladder comprising a plurality of U-shaped modules comprising a rung and two vertical portions, said modules movably connected to each other, and when opened becoming progressively narrower as they approach the top of said ladder, when folded said narrower modules fitting inside of the next wider modules, said modules except for said widest base module comprising in their lower portions a complete module locking means and a module hinge means, said locking means fixing said modules in a rigid manner when said ladder is extended and open, said locking means integral with said modules and comprising latches adapted to movably fit into and mate with an aperture located in the upper sections of said vertical portions of said modules, and tapered grooved guide portions immediately adjacent said apertures to facilitate easy entrance of said latch into said aperture.

2. The ladder of claim 1 wherein said hinges are postioned in the lower portion of said U-shaped section.

3. The ladder of claim 1 wherein said hinges are postioned above said latches in each U-shaped section.

4. The ladder of claim 1 wherein said hinges connect the lower portion of a U-shaped section to the upper vertical portion of the U-shaped section immediately below it.

5. The ladder of claim 1 wherein said latches are spring loaded permiting them to be locked in position when located in said aperture.

6. The ladder of claim 1 wherein said latches are connected to latch releases, said latch releases located externally of the rungs of said ladder.

7. The ladder of claim 1 wherein said aperture has immediately adjacent it on both sides, a tapered groove portion that permits easy entrance of said latch into said aperture.

8. The ladder of claim 1 wherein said latch and aperture are square.

9. The ladder of claim 1 wherein said latch and aperture have the same configuration to permit easy mating of the two.

10. The ladder of claim 1 said latch releases are movably located in the center portion of said rungs on the same level as said latches.

11. The ladder of claim 1 wherein said locking means are located in the bottom section of the narrower module and the top section of the next adjacent wider module, said locking means comprising a male member adapted to fit into and lock with an adjacent female member when said ladder is in an open and extended mode, said male member being positioned in the vertical portions of said ladder.

12. The ladder of claim 1 wherein said locking means are located in the bottom section of the narrower module and the top section of the next adjacent wider module, said locking means comprising a male member adapted to fit into and lock with an adjacent female member when said ladder is in an open and extended mode, said male member being positioned in the horizontal portions of said ladder.

13. The ladder of claim 1 wherein the vertical sections of said modules have tapered groove portions that permit easy entrance of said locking means into the next adjacent module.

14. The ladder of claim 1 wherein said hinges are positioned above said locking means in each module.

15. The ladder of claim 1 wherein said hinges are positioned below said locking means in each module.

* * * * *